US011568845B1

(12) United States Patent
Manimala

(10) Patent No.: US 11,568,845 B1
(45) Date of Patent: Jan. 31, 2023

(54) METHOD OF DESIGNING AN ACOUSTIC LINER

(71) Applicant: Board of Regents for the Oklahoma Agricultural & Mechanical Colleges, Stillwater, OK (US)

(72) Inventor: James Mathew Manimala, Stillwater, OK (US)

(73) Assignee: Board of Regents for the Oklahoma Agricultural & Mechanical Colleges, Stillwater, OK (US)

( * ) Notice: Subject to any disclaimer, the term of this patent is extended or adjusted under 35 U.S.C. 154(b) by 487 days.

(21) Appl. No.: 16/546,056

(22) Filed: Aug. 20, 2019

Related U.S. Application Data

(60) Provisional application No. 62/720,008, filed on Aug. 20, 2018.

(51) Int. Cl.
*G10K 11/162* (2006.01)

(52) U.S. Cl.
CPC ..... *G10K 11/162* (2013.01)

(58) Field of Classification Search
CPC ..... G10K 11/162
USPC ..... 181/286
See application file for complete search history.

(56) References Cited

U.S. PATENT DOCUMENTS 3,821,999 A 7/1974 Guess et al.
5,778,081 A * 7/1998 Patrick ..... G10K 11/161 381/71.7
5,930,371 A * 7/1999 Cheng ..... G10K 11/161 381/71.7
6,134,968 A 10/2000 Kunze, Jr. et al.
6,176,964 B1 1/2001 Parente et al.
6,256,600 B1 7/2001 Bolton et al.
7,401,682 B2 7/2008 Proscia et al.
7,921,966 B2 4/2011 Chiou et al.
9,245,089 B1 1/2016 Nark et al.
9,273,631 B2 3/2016 Vavalle
9,334,059 B1 5/2016 Jones et al.
9,355,194 B2 5/2016 Howerton et al.
9,476,359 B2 10/2016 Soria et al.
9,514,734 B1 12/2016 Jones et al.
9,783,316 B2 10/2017 Alonso-Miralles
9,840,901 B2 12/2017 Oehring et al.
(Continued)

FOREIGN PATENT DOCUMENTS

CN 106919724 A * 7/2017 ..... G06F 30/17
JP 2014129838 A 7/2014
WO 2011056659 A1 5/2011

OTHER PUBLICATIONS

Lothar Bertsch, Werner Dobrzybnski and Sebastien Guerin, "Tool Development for Low-Noise Aircraft Design," 14th AIAA/CEAS Aeroacoustics Conference (29th AIAA Aeroacoustics Conference), May 5-7, 2008, Vancouver, British Colombia, Canada.
(Continued)

*Primary Examiner* — Forrest M Phillips
(74) *Attorney, Agent, or Firm* — McAfee & Taft

(57) ABSTRACT

A method of designing an acoustic liner includes identifying acoustic path lengths that will attenuate a frequency within a frequency range of interest, and selecting a liner configuration with a combination of acoustic paths that addresses the frequency range of interest. The selection may be made after a comparison of the response of different liner configurations.

19 Claims, 13 Drawing Sheets

(56) References Cited

U.S. PATENT DOCUMENTS

| | | | | |
|---|---|---|---|---|
| 10,082,058 | B2 * | 9/2018 | Creager | F01N 1/165 |
| 10,319,121 | B2 | 6/2019 | Hirosawa | |
| 10,699,693 | B1 * | 6/2020 | Chung | H04R 1/283 |
| 10,796,680 | B2 * | 10/2020 | Fang | G10K 11/162 |
| 11,151,974 | B1 * | 10/2021 | Dingli | G10K 11/17823 |
| 11,214,350 | B2 * | 1/2022 | Prakash | G10K 11/162 |
| 11,240,635 | B1 * | 2/2022 | Eckert | H04W 4/029 |
| 2002/0036115 | A1 * | 3/2002 | Wilson | F02C 7/045 181/290 |
| 2006/0236973 | A1 * | 10/2006 | Seibt | F02M 35/125 123/198 E |
| 2011/0162910 | A1 | 7/2011 | Chiou et al. | |
| 2012/0156006 | A1 | 6/2012 | Murray et al. | |
| 2012/0291618 | A1 | 11/2012 | Hanan | |
| 2015/0367953 | A1 | 12/2015 | Yu et al. | |
| 2017/0303059 | A1 | 10/2017 | Herrera et al. | |
| 2018/0018952 | A1 | 1/2018 | Herrera | |
| 2018/0245516 | A1 | 8/2018 | Howarth et al. | |
| 2018/0330737 | A1 | 11/2018 | Paulik et al. | |
| 2020/0018218 | A1 * | 1/2020 | Dmytrow | F01N 1/00 |
| 2022/0018363 | A1 * | 1/2022 | Hakuta | G10K 11/16 |
| 2022/0034085 | A1 * | 2/2022 | Kono | E04B 1/99 |

OTHER PUBLICATIONS

Zhenbo Lu, Xiaodong Jing, Xiaofeng Sun and Xiwen Dai, "An investigation on the characteristics of a non-locally reacting acoustic liner," Journal of Vibration and Control, 2014.

Haukur E. Hafsteinsson, Lars-Erik Eriksson, Niklas Andersson, Pablo Mora, Ephraim Gutmark and Erik Prisell, "Exploration of temperature effects on the far-field acoustic radiation from a supersonic jet," American Institute of Aeronautics and Astronautics, Jun. 2014.

Dr. Neil Dickson, ICAO Air Transport Bureau, "Aircraft Noise Technology and International Noise Standards," 2015.

Marc Versaevel, Laurent Moreau and Emmanuel Lacouture, "Folded spiral-shaped cavities for nacelle acoustic liners: Impedance and attenuation modelling and comparison to experimental results," 3 AF Greener Aviation Conference, Oct. 2016.

Federal Aviation Administration, "Aircraft Noise Issues," FAA Policy Website, 2018.

E. Shamonina and L. Solymar, "Metamaterials: How the subject started," Invited Review, Science Direct, pp. 12-18, published by Elsevier B. V., available online Feb. 8, 2007.

J. J. Kelly and H. Abu-Khajeel, "A User's Guide to the Zwikker-Kosten Transmission Line Code (ZKTL)," National Aeronautics and Space Administration, Dec. 1997, Langley Research Center, Hampton, Virginia 23681-2199.

Junis Abdel Hay, Stefan Busse-Gerstengarbe, Christoph Richter, Frank Thiele, Lutz Blohm and Lars Enghardt, "A Comprehensive Study on Non-Locally Reacting Liners, Part 2: Impedance Eduction and Liner Modeling," American Institute of Aeronautics and Astronautics, Inc, Aeroacoustic Conferences, May 27-29, 2013, Berlin, Germany.

Zhenbo Lu, Xiaodong Jing, Xiaofeng Sun and Xiwen Dai, "An investigation on the characteristics of a non-locally reacting acoustic liner," Journal of Vibration and Control; accepted Jul. 16, 2014.

Douglas M. Nark and Michael G. Jones, "Development of a Multifidelity Approach to Acoustic Liner Impedance Eduction," American Institute of Aeronautics and Astronautics, NASA Langley Research Center, Hampton, Virginia 23681-2199, 2012.

Dr. L. W. Dean, "Coupling of Helmholtz Resonators To Improve Acoustic Liners for Turbofan Engines At Low Frequency," Pratt & Whitney Aicraft Division, United Technologies Corporation, NASA Lewis Research Center, Aug. 1975.

D. T. Sawdy and R. J. Beckemeyer, "Bandwidth Attenuation with a Folded Cavity Liner in a Circular Flow Duct," AIAA Journal, vol. 18, No. 7, 1980.

O. Bschorr and E. Laudien, "The Silator—A Small Volume Resonator," Journal of Sound and Vibration, pp. 81-92, 1992.

Leslie A. Momoda, "The Future of Engineering Materials: Multifunction for Performance-Tailored Structures," The Bridge, National Academy of Engineering, pp. 18-21, Winter 2004.

Sung Soo Jung, Yong Tae Kim and Yong Bong Lee, "Measurement of Sound Transmission Loss by Using Impedance Tubes," Journal of the Korean Physical Society, vol. 53, No. 2, pp. 596-600, Aug. 2008.

Lee Fok, Muralidhar Ambati and Xiang Zhang, "Acoustic Metamaterials," MRS Bulletin, vol. 33, Oct. 2008, pp. 931-934.

Lothar Bertsch, Werner Dobrzynski and Sebastien Guerin, DLR German Aerospace Center, "Tool Development for Low-Noise Aircraft Design," Journal of Aircraft, vol. 47, No. 2, pp. 694-699, Mar.-Apr. 2010.

Haukur E. Hafsteinsson, Markus O. Burak, Lars-Erik Eriksso and Mattias Billson, "Experimental and Numerical Investigation of a Novel Acoustic Liner Concept," 16th AIAA/CEAS Aeroacoustics Conference, Jun. 7-9, 2010, Stockholm, Sweden.

Jorge P. Arenas and Malcolm J. Crocker, "Recent Trends in Porous Sound-Absorbing Materials," Sound & Vibration, pp. 12-17, Jul. 2010.

Rie Sugimoto, Jeremy Astley and Paul Murray, "Low frequency liners for turbofan engines," Proceedings of 20th International Congress on Acoustics, ICA, Aug. 23-27, 2010, Sydney, Australia.

Mehdi R. Khorrami, "Airframe Noise Reduction Status and Plans," AIAA Aero Sciences Meeting, Jan. 4-7, 2011.

M. G. Jones and B. M. Howerton, "Evaluation of Parallel-Element, Variable-Impedance, Broadband Acoustic Liner Concepts," 18th AIAA/CEAS Aeroacoustics Conference (33rd AIAA Aeroacoustics Conference), Jun. 4-6, 2012, Colorado Springs, Colorado.

Matthew Paul Allen, "Analysis and Synthesis of Aircraft Engine Fan Noise for Use in Psychoacoustic Studies," Thesis submitted to the faculty of the Virginia Polytechnic Institute and State University in partial fulfillment of the requirements for the degree of Master of Science in Mechanical Engineering, Blacksburg, Virginia, Apr. 18, 2012.

Andrew T. Chambers, "Development of Lightweight, Compact, Structurally-Integrated Acoustic Liners for Broadband Low-Frequency Noise Mitigation," Submitted to the Faculty of the Graduate College of the Oklahoma State University in partial fulfillment of the requirements for the Degree of Master of Science, May 2017.

Andrew Chambers, James M. Manimala and Michael G. Jones, "Improved Low-Frequency Broadband Absorption using 3D Folded Cavity Acoustic Liners," Noise-Con 2017, Grand Rapids, Michigan, Jun. 12-14, 2017.

Junis Abdel Hay and Frank Thiele, "Modeling and Numerical Analysis of a Non-Locally Reacting Liner," The 21st International Congress on Sound and Vibration, Beijing, China, Jul. 13-17, 2014.

James M. Manimala and C. T. Sun, "Microstructural design studies for locally dissipative acoustic metamaterials," Journal of Applied Physics, Submitted Nov. 3, 2013, Accepted Dec. 23, 2013, Published Jan. 13, 2014, https://doi.org/10.1063/1.4861632.

James M. Manimala, Hsin Haou Huang, C.T. Sun, Robert Snyder and Scott Bland, "Dynamic load mitigation using negative effective mass structures," Engineering Structures 80 (2014) 458-468, Received Oct. 10, 2013, Revised May 12, 2014, Accepted Aug. 31, 2014, Available online Oct. 3, 2014, http://dx.doi.org/10.1016/j.engstruct.2014.08.052.

Alexander Svetgoff and James Manimala, "Absorption characteristics of membrane-embedded acoustic iners," Inter-Noise 2018, Impact of Noise Control Engineering, Chicago, Illinois, Aug. 26-29, 2018.

* cited by examiner

METHOD OF DESIGNING AN ACOUSTIC LINER

BACKGROUND

There are a number of industries and settings in which a high level of noise is produced. The noise spectrum may occur across a broad range of frequencies. In the aircraft industry, turbofan engines are a significant contributor to aircraft noise. The noise generated by turbines often includes noise with dominant low frequency content.

Airborne noise with dominant low-frequency content can have detrimental effects in many applications. It can excite structural vibration modes, causing increased wear and tear, and even catastrophic failure. It may contribute to cabin noise which is a source of passenger discomfort in air vehicles, degrade payload integrity, and restrict military mission capabilities when stealth is essential. Such noise can also contribute to environmental or community noise pollution, which is becoming more regulated across the globe, making the reduction of such noise a significant concern. Moreover it is a major contributor to environmental noise pollution, which is a major global concern especially in commercial aviation. Typically, lower-frequency content is less evanescent and persists over longer aerial distances. Conventional approaches using acoustic liners, foams or claddings often become impractical for low-frequency spectra owing to space and weight considerations. One of the most common ways to mitigate noise, especially in engine ducts or over airframe structures is through the use of acoustic liners. Conventional perforate-over-honeycomb liners are tuned to dissipate acoustic energy, create destructive interference for the incident sound wave, and sequester tonal energy using acoustic resonators. The acoustic and structural configurations of liners determine their effectiveness for specific target frequency ranges and application scenarios. The majority of acoustic liners in use today are ineffective at absorbing sound with dominant frequency content below 1000 Hz. Conventional acoustic liners currently in service in aerospace applications do not address these low frequencies because of volume and weight constraints.

BRIEF DESCRIPTION OF THE DRAWINGS

FIGS. 6 and 7 are depictions of exemplary acoustic liners designed with the method described herein.

FIG. 8 is a cross section from line 8-8 of FIG. 6.

DESCRIPTION OF AN EMBODIMENT

Figure 1:
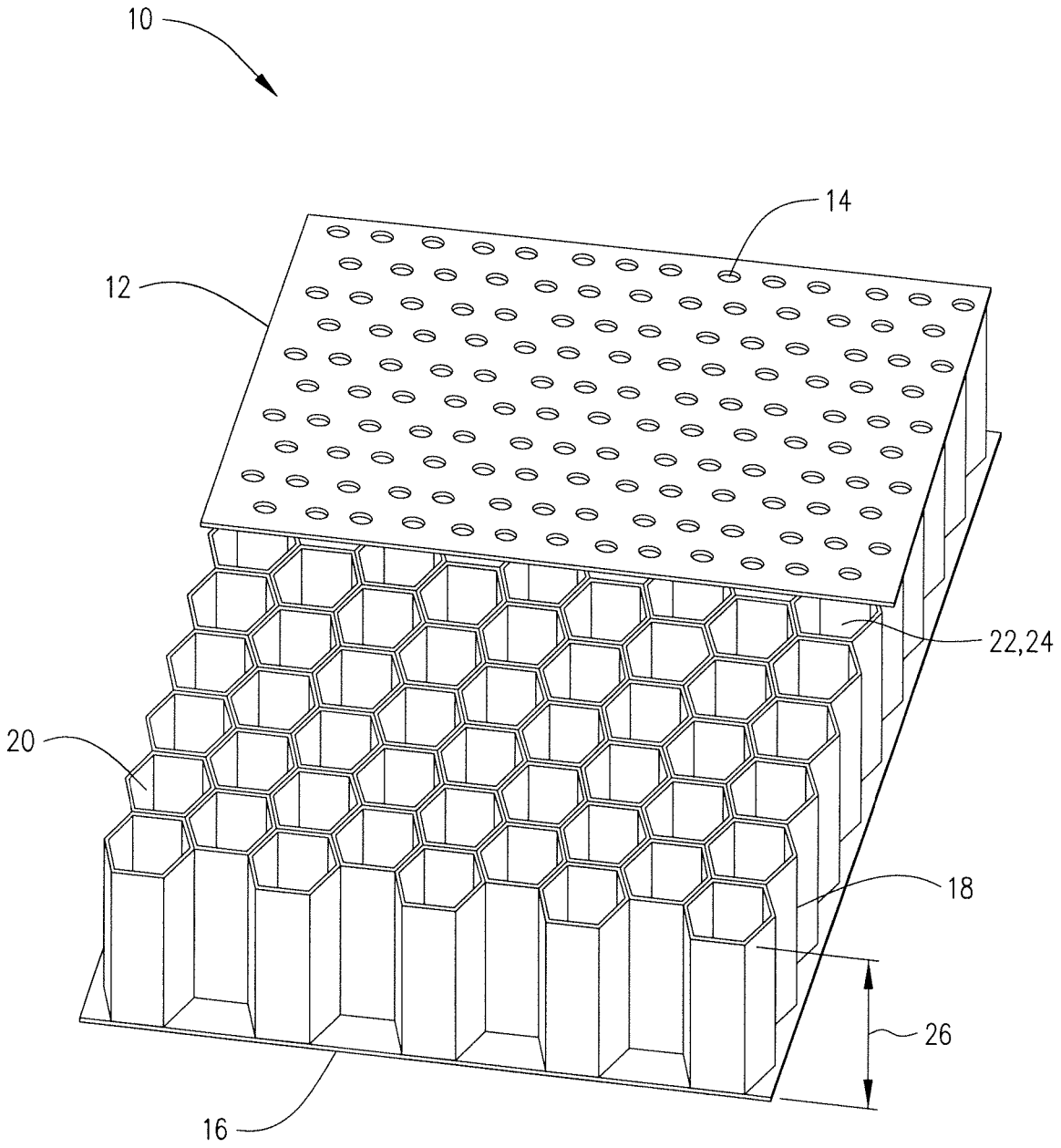
FIG. 1 PRIOR ART
FIG. 1 is a depiction of a prior art acoustic liner section.

The figures herein, and in particular FIGS. 3-8, show acoustic liner constructions comprising a perforated face sheet with a plurality of openings, an impervious back plate and a structure between the face sheet and back plate. The structure in the prior art embodiment is a core made up of a plurality of core cells. A conventional prior art single layer acoustic liner 10 is shown in FIG. 1. Prior art liner 10 has face sheet 12 which is a perforated face sheet with holes 14. A back plate 16 is spaced from face sheet 12 and has a core 18 therebetween. Back plate 16 is impervious to air. Core 18 is made up of a plurality of cells 20. Holes 14 are each positioned over a cell 20 and are in communication therewith. An available volume 22 for the core is defined between face sheet 12 and back plate 16, and is essentially the available space 24 between the face sheet 12 and back plate 14. The cell depth 26 is determined by the space 24. Generally, in such an arrangement it is the cell cavity depth and to a lesser extent width that control the frequency at which maximum absorption occurs. The length of the path for the sound wave, which may be referred to as an acoustic path, is the distance between the face sheet and back plate, which is the depth 26 of an individual cell 20.

Liner panel 10 shown in FIG. 1 is a configuration which might typically be used in contemporary aircraft engine nacelle structures. Such liners can attenuate only a portion of the broadband noise created by an aircraft engine. The acoustic signature of an aircraft engine assembly includes sound frequencies that are typically below the frequencies that can be attenuated by a prior art liner as described with respect to FIG. 1.

Although the discussion herein may center around the use of acoustic liners in the aircraft industry, it is understood that acoustic liners and panels may be utilized in a variety of environments including the building and construction industry, inside walls, in HVAC systems, concert halls, wind turbines, in automotive applications, recording studios and other arenas in which the dampening, or attenuation of sound is desired. The methods and apparatus disclosed and claimed herein are applicable to all such environments. Thus, while this disclosure may make reference to the aircraft industry, to which the methods and apparatus are particularly useful, the description herein is non-limiting.

A method for designing acoustic liners that will attenuate, or dampen sound at specified frequencies includes an iterative process that may be described with reference to FIG. 2. A quantitative measure of low-frequency absorption was first developed for use with the algorithm shown in the flow chart in FIG. 2. The measure is identified as a Low-Frequency Performance Metric (LFP). The LFP is a non-dimensionalized metric used as a quantitative comparative measure for designing and determining desired configurations for acoustic liners that will attenuate sound at a given frequency, and in particular frequencies below 1000 Hz, and below 500 Hz.

In the embodiments described, the length of travel for a sound wave through a particular path is referred to as an acoustic path. For example, in the prior art liner shown in FIG. 1, the acoustic path is equal to the depth of an individual core cell. The embodiments described herein are designed to have a plurality of acoustically connected core cells, referred to herein as a core cell cluster. The acoustic path for a core cell cluster channel is an acoustic path through a plurality of acoustically connected core cells in an acoustic liner with a perforated face sheet, a back plate, and a core made up of a plurality of core cells. As a result, a core cell cluster has an acoustic path that is longer than the acoustic path in the prior art acoustic panel.

A cell cluster configuration, which may also be referred to as a liner configuration, refers to the overall configuration of an acoustic liner, or the configuration of a section of an acoustic liner. In other words, a core cell cluster configuration comprises a plurality of core cell clusters in an acoustic liner. Although the discussion herein refers primarily to an acoustic liner wherein the structure in the available volume, (i.e., the space between a face sheet and a back plate) is a core comprised of a plurality of core cells, it is understood that the term acoustic path can be applied to other structures used for an acoustic liner, and may include for example an acoustic path through a tubular channel that may be one of a plurality of tubular channels that make up the structure through which the sound wave propagates in an acoustic liner. If other types of acoustic paths are being considered, for example those in tubular channels as discussed above, a liner configuration would include all of the tubular channels therein, each of which will have an acoustic path therethrough. The acoustic path in the embodiments described with reference to the figures may be referred to as convoluted acoustic paths, in that they alternatively pass through the top and bottom end of adjacent core cells. This is shown and described in more detail below.

The LFP is a measure found by considering the relationship between individual acoustic properties, and is represented by the following:

$$LFP=(\beta M/\zeta)\times 100$$

Figure 11:
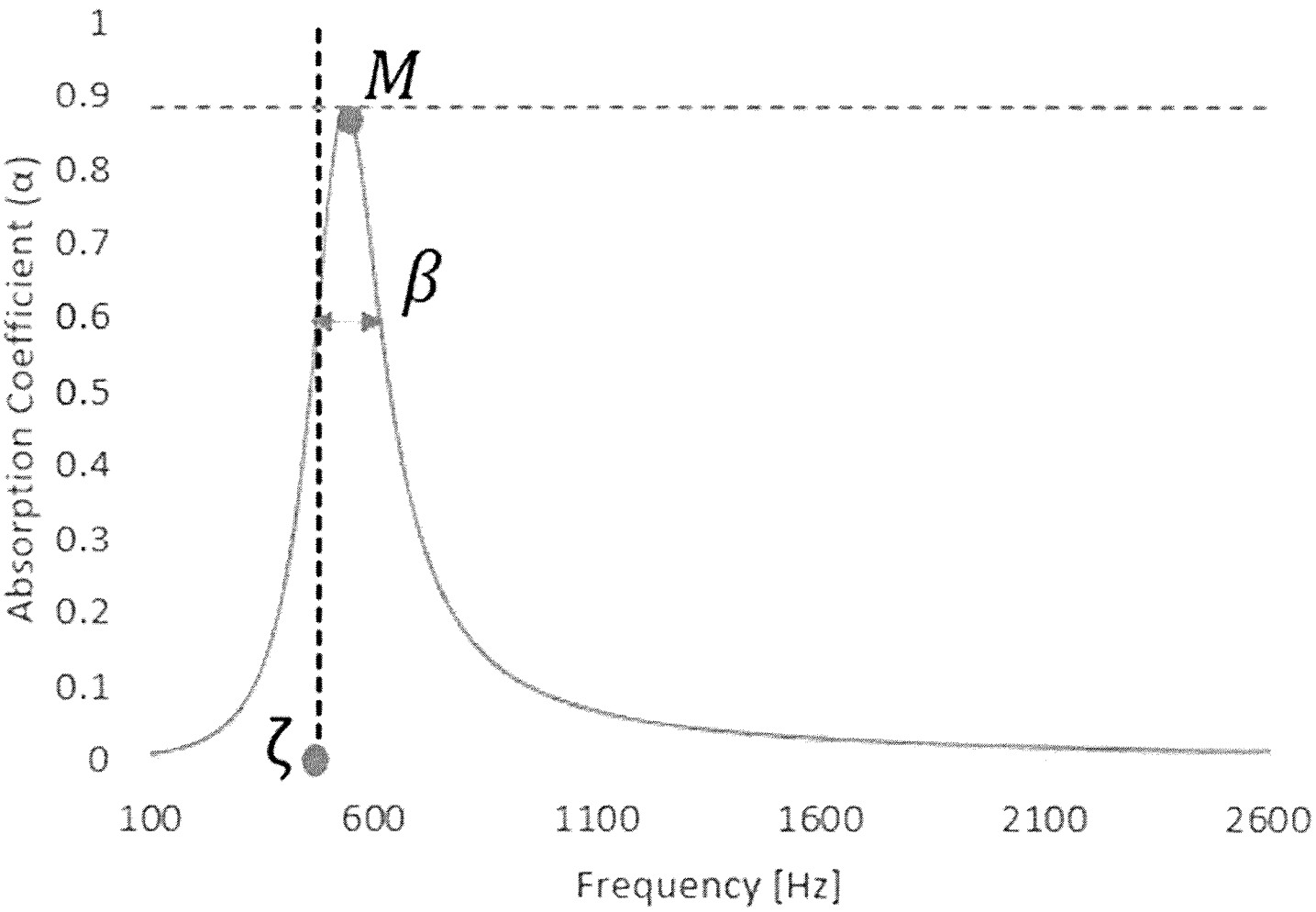
FIG. 11 is a graph of an exemplary response for a single cell cluster.

An LFP for a liner configuration can be directly calculated from the absorption coefficient spectrum predicted by the Zwikker-Kosten Transmission Line Code (ZKTL). In the above equation $\beta$ is the lowest continuous frequency bandwidth where the absorption coefficient ($\alpha$) is greater than the significant absorption threshold specified in the input. M is the maximum peak value of the absorption coefficient within the bandwidth, $\beta$. $\zeta$ is the lower bound of the bandwidth $\beta$. A multiplicative factor of 100 is included to minimize the possibility of rounding errors. The higher the LFP, the better the absorption performance a liner will exhibit. By calculating the LFP from the ZKTL code for each liner configuration in the iterative optimization process, the liner configuration with the best LFP for the targeted frequency range is identified. For example, assuming the frequency range addressed is 0 to 1000 Hz and the significant absorption threshold is 0.6, a graphic representation of the result produced by use of the ZKTL for a single cell cluster with a known acoustic path length might look as shown in FIG. 11.

In the example 0.6 is the absorption threshold specified (i.e., the minimum magnitude of absorption desired) but it is understood that the threshold can be set at a desired level, based on the specific need. In other words, the threshold can be set anywhere between 0 and 1.0 and the LFP still utilized. The example above is for a single cell cluster. Such a calculation might be used, for example, to eliminate cell cluster configurations having a cell cluster that does not respond to the frequency of interest. Normally, an LFP will be calculated for a liner configuration that includes a plurality of cell clusters. The LFP may be characterized as an acoustic property of a liner configuration for an acoustic liner. LFP is a composite metric akin to a single-number performance index for the design. It is not a property of the sound but a measure of how the specific acoustic liner configuration modifies or mitigates the sound.

The initial inputs are the frequency range to be addressed, in other words, the frequency range of the sound to be attenuated, the available liner volume, or the available space in which the structure that defines the acoustic paths may be placed, and in the case of the specific embodiments described herein the depth of an individual cell and the cross-sectional area of the individual cell. As noted above the volume is the area of the face sheet multiplied by the space between the face sheet and the back plate, which is the same as the cell depth. The significant absorption threshold (i.e., the desired minimum amount of absorption) is also an initial input. From the initial inputs, a total number of cells in the liner is obtainable based on the geometry of the acoustic liner or portion of an acoustic liner if only a portion of an acoustic liner is being considered.

From the inputs, different cell cluster configurations can be identified that will respond to the identified frequency (ies) to be attenuated. The method may include within the choose cluster configuration step 36 a preliminary step designed to eliminate cell clusters that will not attenuate a frequency within the identified range based on the inputs. In other words, those clusters which have an acoustic path length that is not sufficient to attenuate a sound having a frequency within the desired range may be disregarded. Only cell clusters with an acoustic path sufficient to attenuate the sound to the desired level based on the desired absorption coefficient will be considered for a liner configuration. Certain cell clusters may be disregarded, or eliminated using known relationships. As stated above, cell clusters may be disregarded by the application of the ZKTL code to single cell clusters. In addition, cell clusters may be eliminated using the relationship $c=f\lambda$, where c is the speed of sound, f is the frequency and $\lambda$ is the wavelength. In a typical acoustic liner for the aircraft industry as described, and for any liner configured with core cells, the lowest frequency corresponding to peak absorption for a given cell depth occurs when the cell depth equals four times the wavelength. In other words, $\lambda=4d$ where d is the total acoustic path length for a given cell cluster.

The foregoing relationship can also be written as $f=(c/4d)$, which defines the frequency absorbed by a quarter-wavelength resonator. Using that relationship, a number of cell clusters can be eliminated because f will be outside the range of interest. All liner configurations that include any cell clusters where f is outside the range of interest are likewise eliminated. Once the cell cluster configurations that fall outside the predetermined range to be addressed are eliminated, the admissible cell cluster configurations are identified.

Once the admissible cell cluster configurations are identified, the LFP is calculated for each. As noted above, the acoustic properties necessary to calculate the LFP may be determined using ZKTL since the frequency range of interest and the absorption coefficient are given. Cavity lengths are set at 38 in FIG. 2. Set cavity lengths is simply the identification or determination of the lengths of the acoustic paths through which the sound wave will propagate for a given cell cluster configuration.

Once the lengths of the acoustic paths in a configuration are determined, and because the frequency range along with the threshold absorption coefficient value is known, $\beta$, M and $\zeta$ can are determined utilizing ZKTL and the LFP calculated. It is understood that the method described herein utilizes ZKTL, other prediction codes, such as finite element analysis may be used.

At step 42 the LFP for each admissible configuration is stored and once the iterative process is complete, the LFPs of the admissible configurations are compared. Application specific selections can then be made. For example, it may be desired to select combinations of cell clusters with different acoustic path lengths so that there will be the desired overall response to different frequencies within the range of interest. Thus, the optimal or preferred liner configuration may consist of a combination of cell clusters with different acoustic path lengths. In certain applications, for example, in the case of an aircraft engine, the frequency range of interest would be somewhat different for take-off, cruising and approach/landing settings. Therefore, multiple frequency ranges would be of interest. In other words, there are three separate frequency ranges of interest. In such a case there can be three different liner configurations utilized for an overall acoustic liner, so that each frequency range of interest is addressed.

Performing the iterations in Block 1 is sufficient for a finished liner design. The liner design will include cell clusters with all cells in a cluster having a full cell depth. The process will be complete with the final design selected based on LFP at step 52 as denoted by line 43. While LFP is the comparative composite acoustic property (factoring in three ($\beta$, M, and $\zeta$) individual acoustic properties) used in the example, further acoustic (or conceivably structural) properties, such as secondary peak magnitude or frequency, parameters to quantify absorption bandwidth continuities, and others, such as structural stiffness and strength may be used. The foregoing examples are non-limiting, and any comparative metric that is a characteristic of the acoustic signature at issue may be used to compare cell cluster configurations that address the characteristic in the desired manner, namely to attenuate the sound.

If it is desired to fine tune, the process in Block 2 may be performed. In Block 2, the iterative process may continue by repeating Block 1 for sub integral cavity lengths for the top integral cavity designs identified in step 1. In other words, the end cell in one cell cluster can be shortened or lengthened by successive predefined amounts, for example one-tenth the depth of the cell. The LFP for each cell cluster with the partial cell depth is calculated, and stored. This process is performed only for those cell clusters that were selected from Block 1. The process can stop after step 46 and go directly to step 52 as indicated by line 47, output of final design.

If further fine tuning is desired, the LFP for cell configurations from steps 44 and 46 can be fine-tuned by considering the sizing for the face sheet perforations, along with thickness of the face sheet and other face sheet characteristics in step 48. It is understood that the face sheet hole is looked at essentially as a micro channel that is part of the cell cluster with which it is associated. ZKTL will consider the opening in the ZKTL analysis to produce a new LFP. The change will be slight, as the size of the perforation is limited and generally can vary only slightly. Once the process is complete, the output with the final design is noted at step 52.

Figure 2:
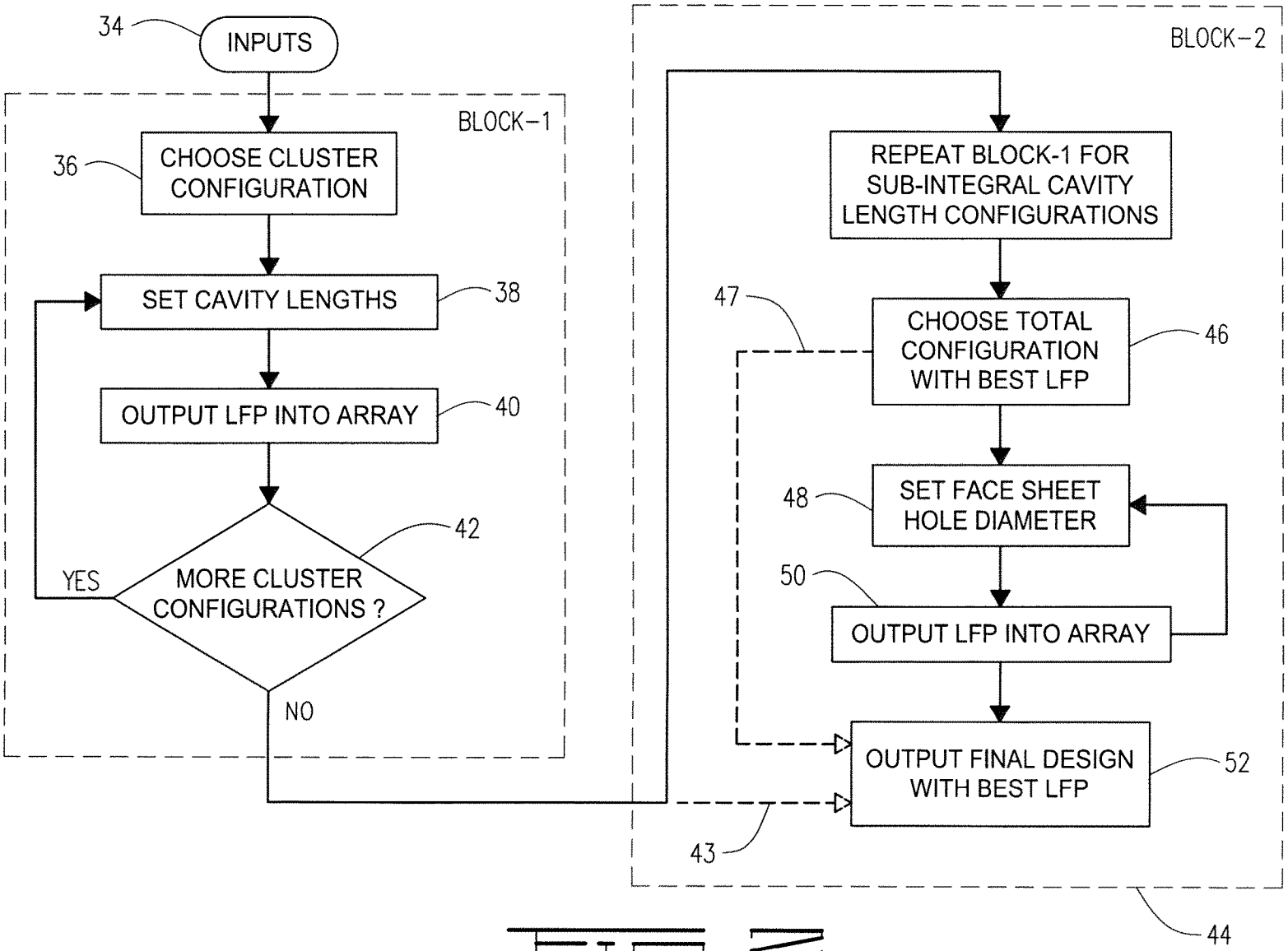
FIG. 2 is a flowchart illustrating a method for designing an acoustic liner.
Figure 3:
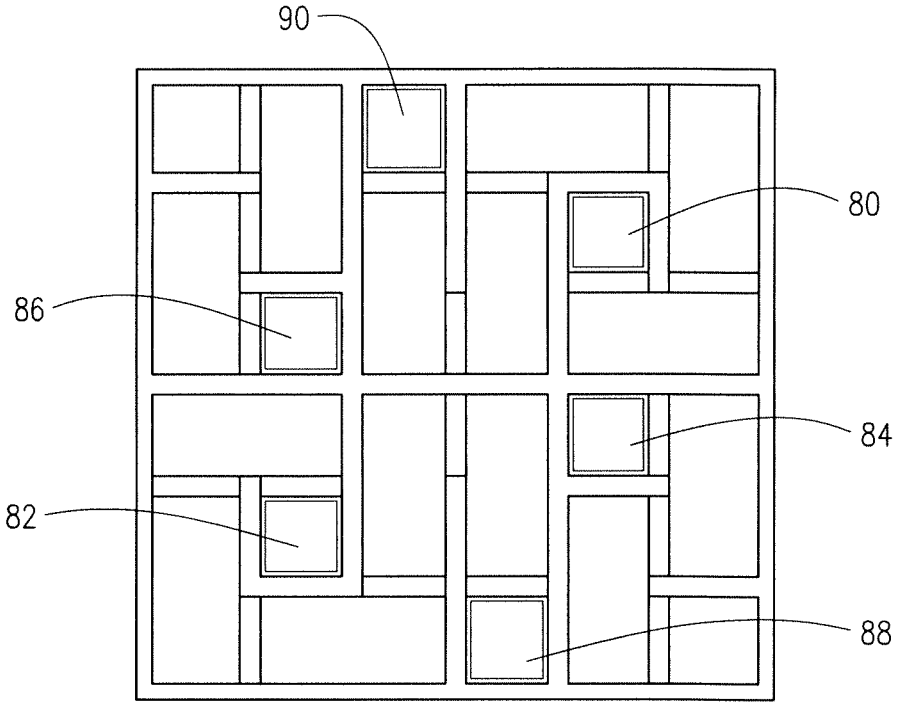
FIG. 3 is a top view of a section of an exemplary acoustic liner designed with the method described without the face sheet.

An analysis and test was conducted for an acoustic liner section to support the effectiveness of the process described in FIG. 2. The analysis was conducted for liner section 60 shown in FIGS. 3, 4 and 5. Liner section 60 has length 62 and width 64. Liner panel section 60 has depth 66. Liner panel section 60 was divided into thirty-six (36) cells 68. Liner panel section 60 included perforated face sheet 70 with perforations 73 and impervious back plate 72. For the analysis conducted, the length and width 62 and 64 were set at 2.00 inches and the depth 66 at 1.50 inches. The individual cell shape was a square set at 0.26444 inches per side, which yielded thirty-six (36) identically sized individual cells. The inputs for the analysis included the liner volume, and cell cavity area which would yield the thirty-six (36) resulting cells. The frequency range (0-500 Hz) along with the significant absorption coefficient, in this case 0.6, are also initial inputs.

Once the inputs are set, the algorithm in Block 1 is used to determine the possible configurations with cell clusters having an integer number of cells that would result in three peaks in the absorption spectrum. In the example, having three distinct peaks in the absorption spectrum was identified as producing some of the widest continuous bandwidth and best LFPs. This was determined by the iterative process described, in which configurations with two peaks and four peaks were eliminated. In other words, from the data generated by the application of the ZKTL code, it was determined that having three distinct peaks was preferred. This is an additional, optional elimination step to improve computational efficiency based on identifying the number of peaks in the absorption spectrum that give the best LFPs. In so doing the computational process was simplified, in that only configurations (i.e., combinations of cell clusters) that generate three peaks are included in the process. This step may be used in addition to that described earlier, in which the relationship $f=c/4d$ noted above may be used to initially eliminate any cell clusters having a length insufficient to address a frequency in the range of interest.

Figure 12:
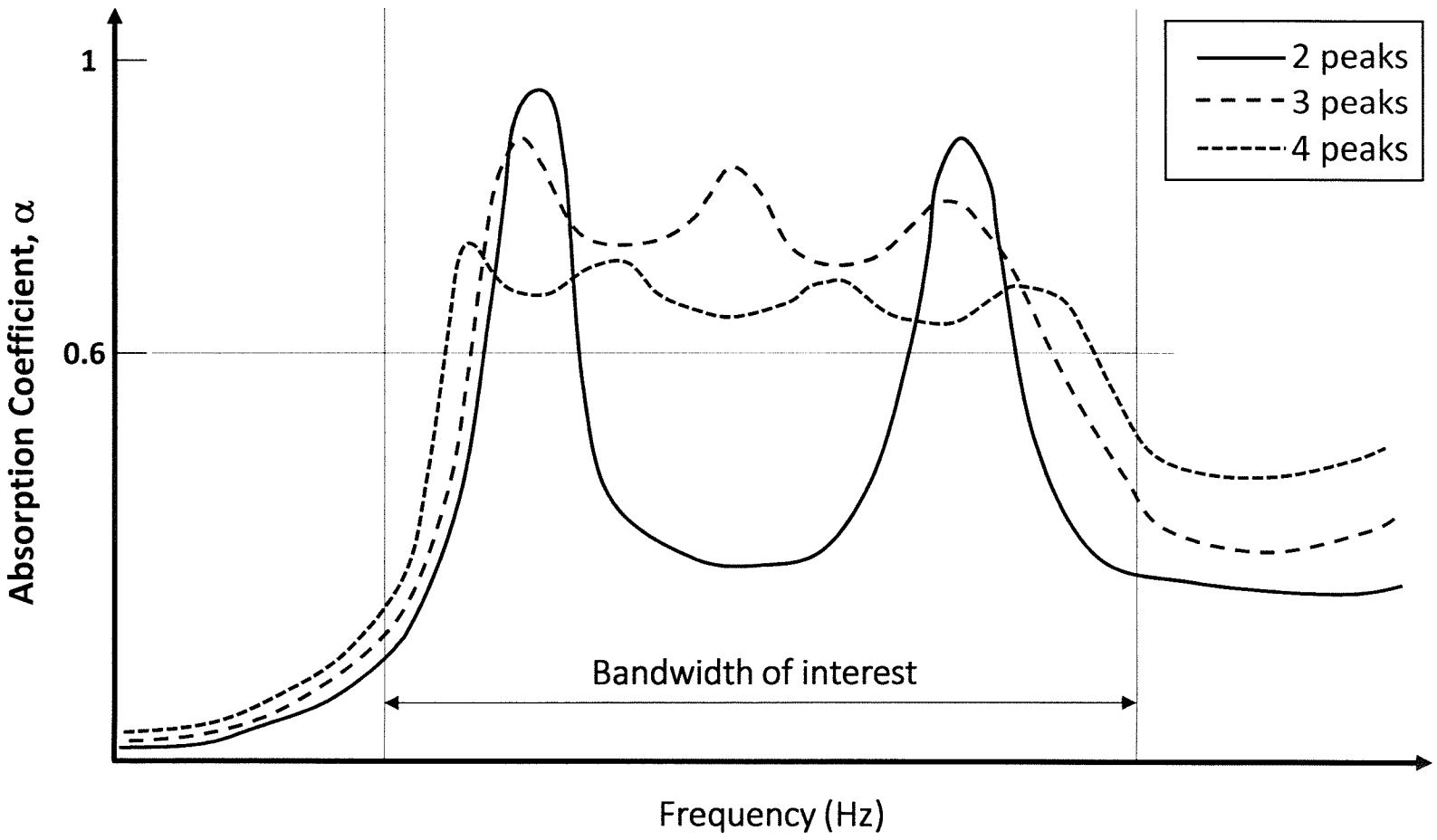
FIG. 12 is an exemplary graph for explanatory purposes.

When a small number of cells is considered as in the test case the additional peak based elimination step may not be necessary, but will be useful when a real life application includes significantly more acoustic path lengths. The graph of FIG. 12 is included for ease of explanation, and is not the exact results of the analysis described. The results of the algorithm applied to the liner 60 provided results akin to those identified in the graph. The configurations with two (2) peaks had a high maximum peak, but low continuous bandwidth. Configurations with four (4) peaks in the absorption spectrum have wide continuous bandwidth, but peaks that are less than desirable. Thus it was determined that configurations with three (3) peaks were preferred.

Figure 4:
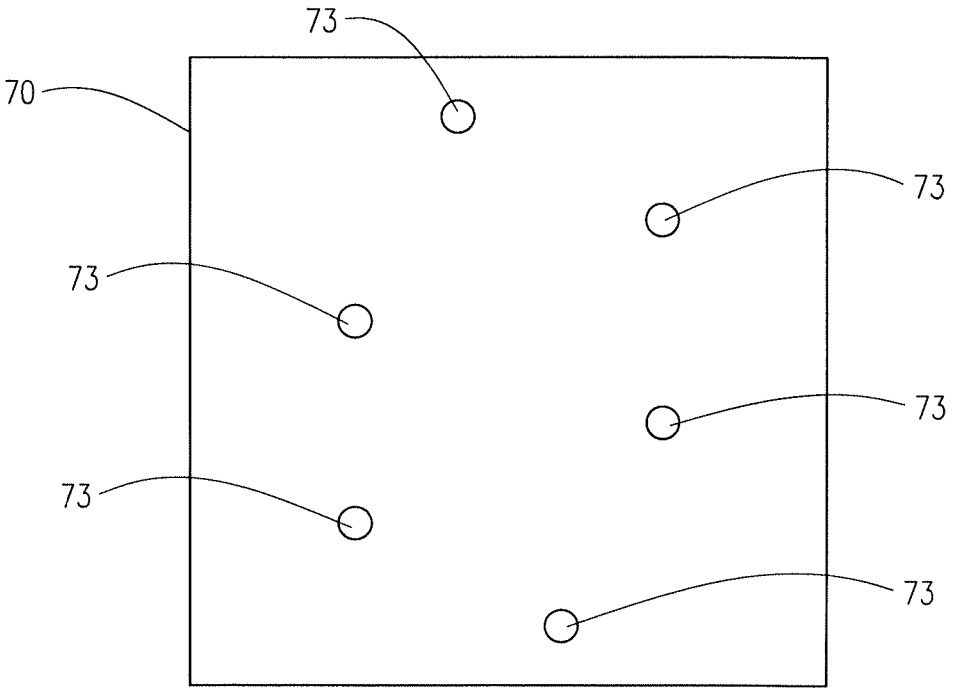
FIG. 4 is a perspective view of the exemplary acoustic liner of FIG. 2
Figure 5:
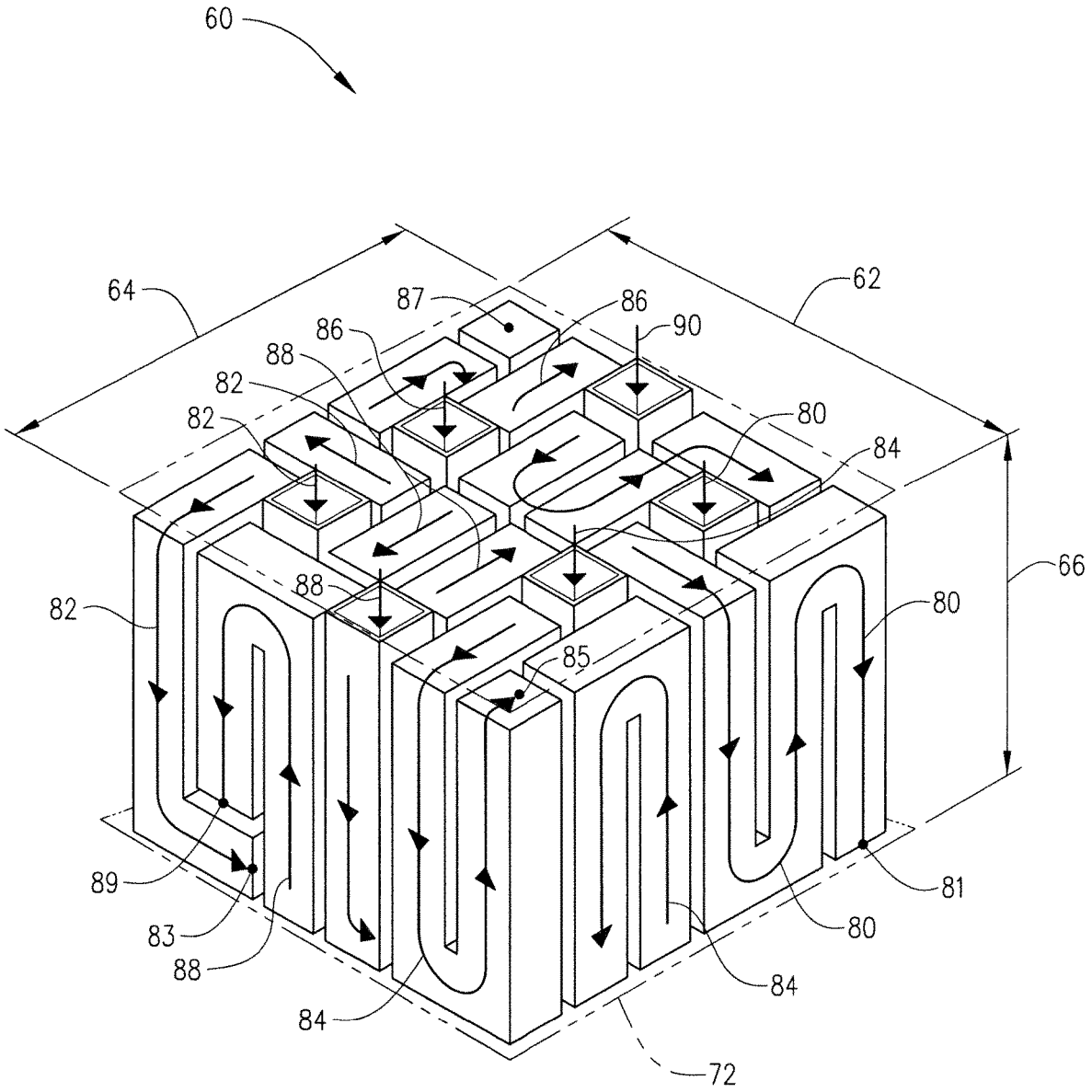
FIG. 5 is a face sheet for the exemplary acoustic liner of FIG. 2.
Figure 5:
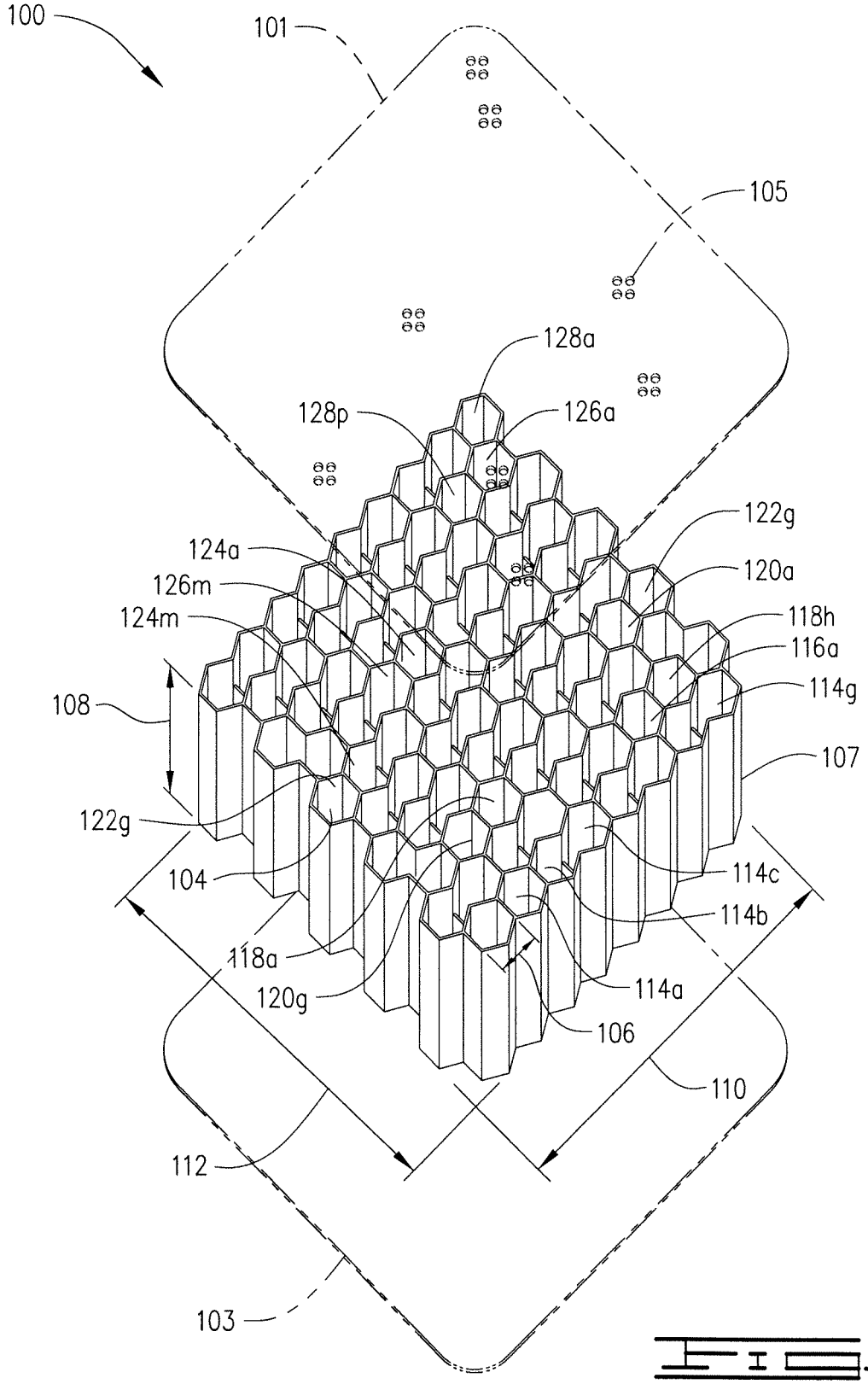

Once the admissible configurations were narrowed, the available cells were apportioned into three distinct cell cluster types and assumed to have an integer number of cells. Given the 6×6 cell arrangement chosen in the test case, the Block 1 process shown in FIG. 2, the best three distinct cell clusters results in three consecutive integer number of cells to result in distinct absorption peaks with a continuous bandwidth. For example, it is found through the LFP-based comparison that a 6×6 configuration as described apportioned into two clusters of five cells, two clusters of six cells and two clusters of seven cells for a total of 36 cells with a configuration and identified with the notation: [5(2), 6(2), 7(2)] yields the best performance. This is the configuration selected for further optimization from among the other 3 cell cluster configurations based on simulations. Other potential configurations are eliminated based on the LFP based analysis. Cell cluster configurations for which any constituent cell cluster's total cavity length is not sufficient to reach the target frequency can be immediately eliminated as inadmissible based on the calculation described above, namely $c=f\lambda$ where $\lambda=4d$, which is the total acoustic path length. Once the admissible liner configuration options with cell clusters having integral number of cells is known and the desired configuration is identified through the LFP analysis, further optimization for partial cell depths resulting from this chosen desired configuration are then performed in Block 2. For partial cell depth optimization runs, the total cavity length of the "middle" (6-cell) cluster is fixed, while the total cavity lengths for the shorter and longer of the three clusters are differentially varied over one cell depth to identify the liner configuration with the best performance. In the present case, the preliminary configuration, [5(2), 6(2), 7(2)] identified above was optimized at steps 44 and 46 to the liner configuration, [$5^{+}$(2), 6(2), $7^{-}$(2)], as shown in FIGS. 4 and 5. At the same time, the relative partial cell lengths are chosen such that there are no acoustically "dead" volumes in the liner design which is ideal from a 3D packaging perspective and especially desirable for weight and volume sensitive applications such as in the aerospace industry. In other words, there are no cavities, or portions of cavities in which there is no sound wave propagation. Further, once the best liner configuration is identified at step 46, the performance can be optimized for face sheet porosity for a given face sheet thickness (other face sheet parameters may be considered as well) using the LFP to arrive at the final design including the face sheet. The optimal face sheet hole diameter was found to be 2 mm (0.0787 in) for the configuration considered. The process described in Block 2 may be conducted using the same analysis tool (i.e., ZKTL) embedded within the LFP-based analysis. Although ZKTL is described as the method used for the analysis, it is understood that other methods, for example finite element analysis, may be used.

Figure 13:
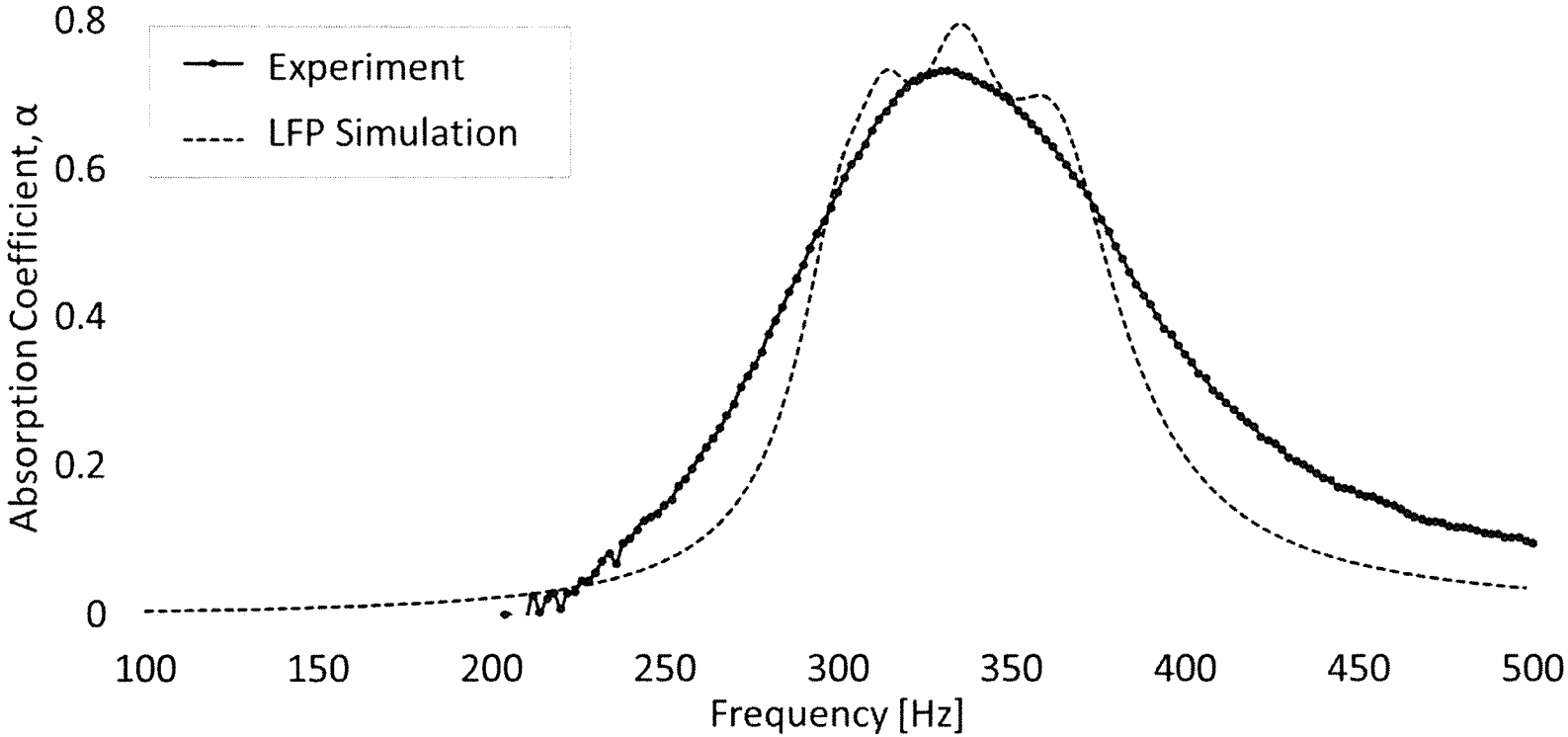
FIG. 13 illustrates the experimental test results and the results of an LFP-based analysis.

The graphic of FIG. 13 illustrates the experimental test results and the results of the LFP-based analysis described. The resonance peaks are due to the optimal spectral spacing of the three-dimensional cell clusters having acoustic paths of different lengths.

The LFP for the selected liner configuration was determined to be 33.8. By efficiently utilizing a prescribed liner volume by providing a plurality of length acoustic paths of different lengths, exceptional broadband absorption is demonstrated to be achievable at frequencies below 500 Hz with a 38.1 mm (1.5 in)-deep liner. The combination of the LFP metric and the ZKTL-based optimization procedure yields noise absorption solutions tailorable for specific low frequency bandwidths. Optimizing the relative lengths of the acoustic paths to tune the peak locations within the absorption coefficient spectrum can enhance the bandwidth of absorption that the acoustic liner exhibits. More than 100 Hz of continuous bandwidth with absorption coefficient greater than 0.6 is shown to be possible in the 250 to 400 Hz range with a 38.1 mm (1.5 in)-deep liner in the design study undertaken. Test liner panel section 60 thus includes cell clusters 80 and 82 with five (5) cells, 84 and 86 with six (6) cells and 88 and 90 with seven (7) cells. The lines and arrows reflect the connected cells for each cell cluster. Cell clusters 80, 82, 84, 86, and 88 terminate at 81, 83, 85, 87 and 89, respectively. Cell cluster 90 terminates on the back plate and is not visible in the views shown. As explained, after the steps in Block 1 are performed, cell clusters in the cell cluster configurations to be further refined, or tuned would contain an integer number of cells. In many cases no further processing is needed or desired. The Block 2 process will yield a fine-tuned liner section as described in the example.

Figure 7:
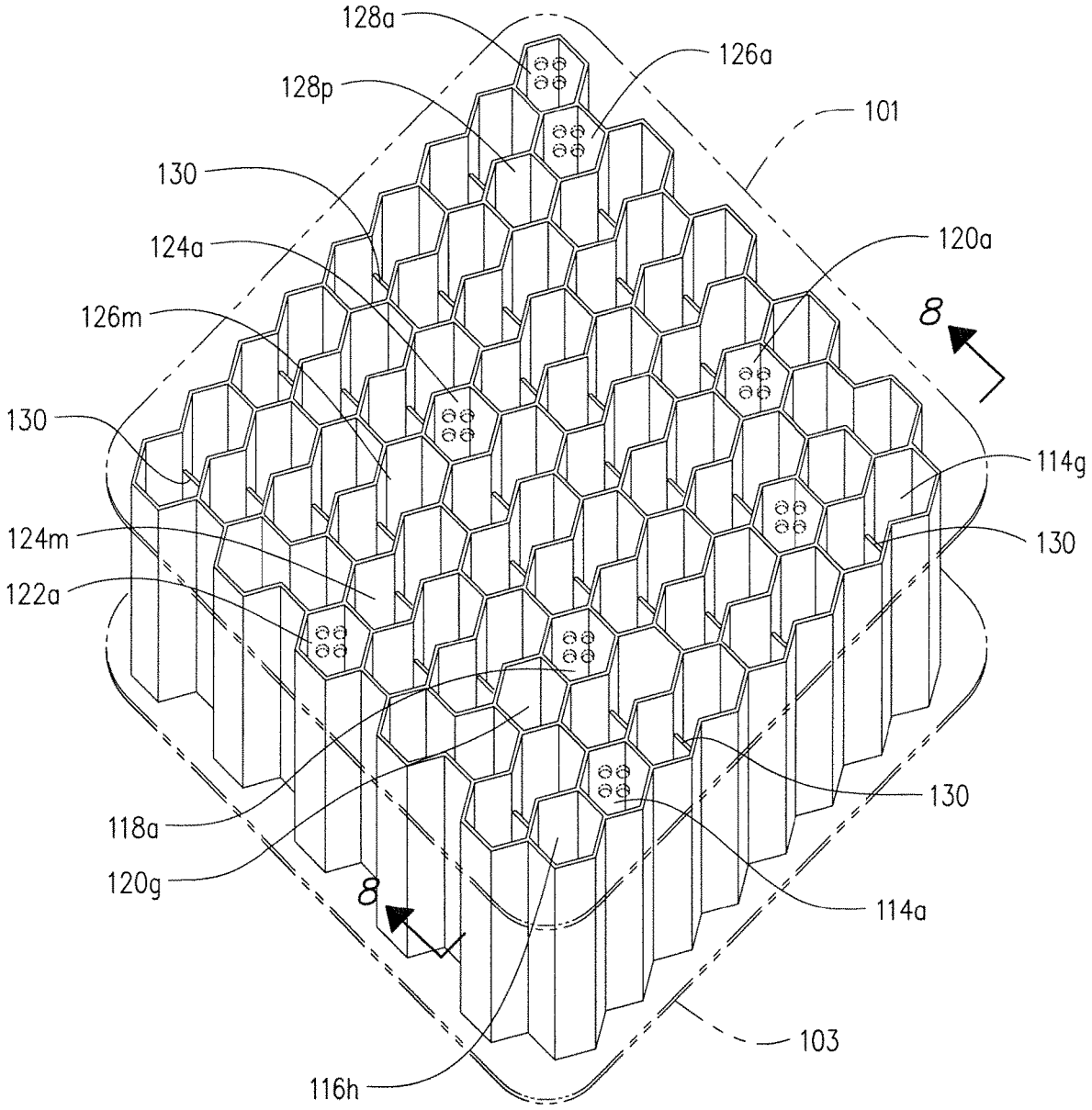
Figure 9:
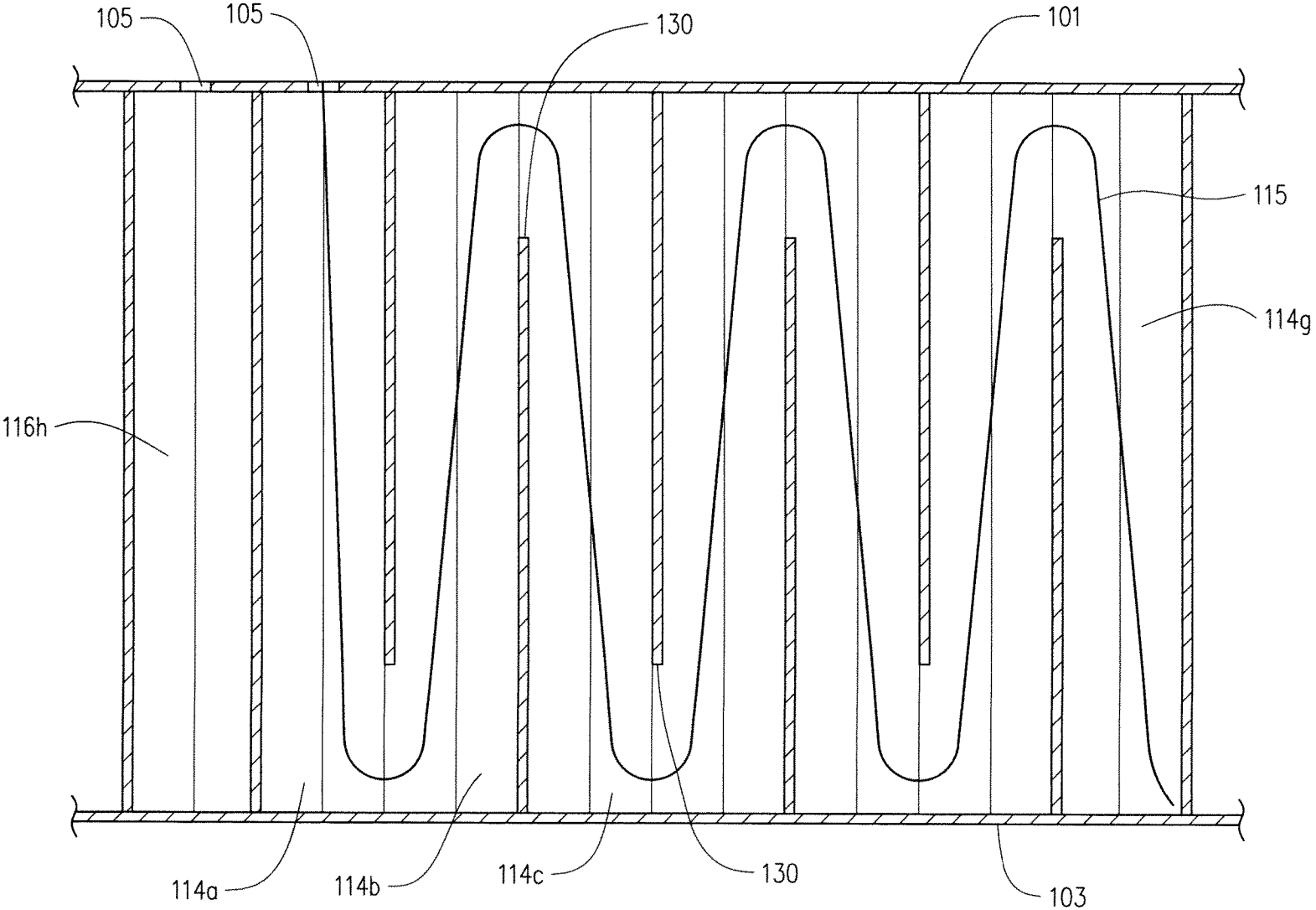
FIGS. 9 and 10 are depictions of additional exemplary acoustic liners designed with the method described herein.
Figure 9:
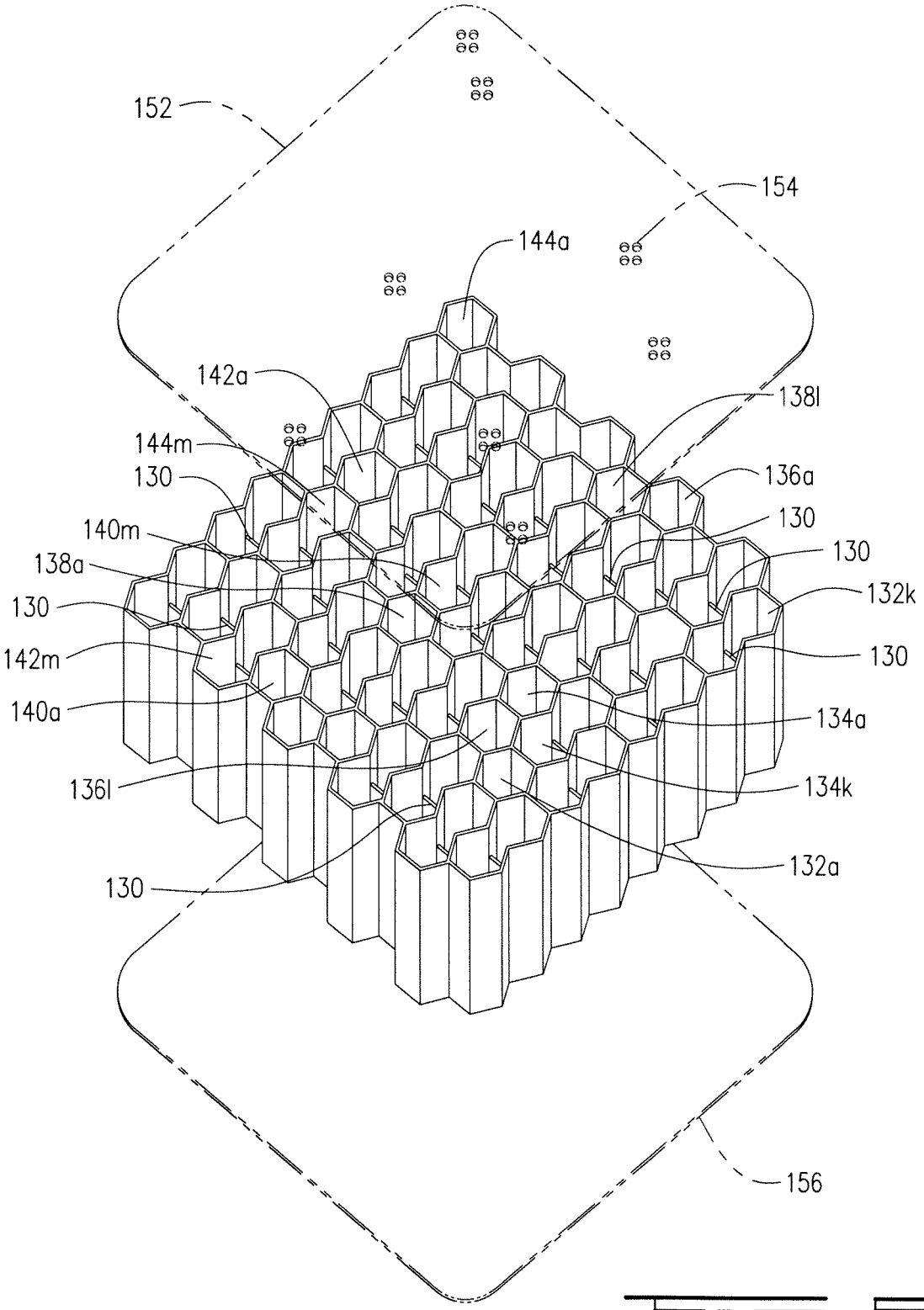

FIGS. 6 and 9 are additional examples of liner panel sections 100 and 102. FIGS. 6 and 7 show a liner panel section 100 with face sheet and back plate 101 and 103. Face sheet 101 has perforations 105 therein to communicate with the core cells 104 in the core 107 respectively and a plurality of individual cells 104. Each cell 104 in the embodiment shown is a hexagonal cell 104 with a short diagonal 106. Cell 104 has a depth 108. An analysis was conducted utilizing the algorithm as described herein. The inputs for the algorithm were depth 108 which in the example provided was 0.50 inches and the short diagonal length 106 of the hexagonal shape which was 0.250 inches. The area was defined by width 110 and length 112 both of which were 2.25 inches which resulted in 85 cells. The significant absorption coefficient 0.6.

In this case the execution of the algorithm included only Block 1 and so there are no partial cell depths in the resulting design. The resulting design for liner panel section 100 resulted in one cell cluster 114 with seven (7) cells, two cell clusters 116 and 118 each including eight (8) cells. Two cells 120 and 122 which include ten (10) cells each, two cells 124 and 126 which include thirteen (13) cells respectively, and one cell cluster 128 which includes sixteen (16) cells. Each cell cluster configuration includes a letter subscript associated therewith for the first and last cell in a cluster to easily identify each cell cluster. In other words, first and last cells in cell cluster 114 are identified as individual cells 114*a* and 114*g*, first and last cells in cluster 116 are identified as cells 116*a* and 116*h* and so on for each cell cluster. As described herein each cell cluster is connected as a result of a cut in the cell walls. As an example, the section view of cell cluster 114 in FIG. 8 shows an entry of cell cluster 114*a*. A channel cut 130 is made at a lower end of the wall which divides cells 114*a* and 114*b*. A channel cut 130 likewise exists at the top of the wall separating cell cluster cells 114*b* and 114*c*. This pattern is repeated until the end cell, which in the case of a seven (7) cell cluster is in cell 114*h*, and thus convoluted acoustic path 115 is generated having a length that extends from 114*a* in a convoluted manner until it terminates at a termination point which in the seven (7) cell cluster is at the bottom end of cell 114*g*. The termination point is on back plate 103. Thus, as shown each cell cluster will have an entry that is communicated with an opening or a perforation 105 on face sheet 101 and will likewise have a termination point. The termination point may be at the back plate 103 or face sheet 101 depending upon the number of cells in the particular cell cluster configuration.

The frequency response of the particular cell cluster configuration for the embodiment of FIG. 6 is as follows. Cluster 114 attenuates sound having a frequency of 1125 Hz to the desired level. Clusters 116 and 118 attenuate sound having a frequency of 844 Hz. Clusters 116 and 118 attenuate sound having a frequency of 844 Hz Clusters 120 and 122 attenuate sound having a frequency of 844 Hz. Clusters 124 and 126 attenuate sound having a frequency of 519 Hz and cluster 128 attenuates sound having a frequency of 422 Hz. Thus the analysis described generated data indicating three peaks in the absorption spectrum was a desirable configuration. The above configuration would address a frequency range of interest of, for example, 400-1200 Hz. The analysis described can be conducted for particular acoustic liner sections and then simply repeated for the overall liner. If preferred, the overall volume of the liner may be considered and utilized in the analysis to arrive at a cell cluster arrangement for an overall acoustic liner.

Figure 10:
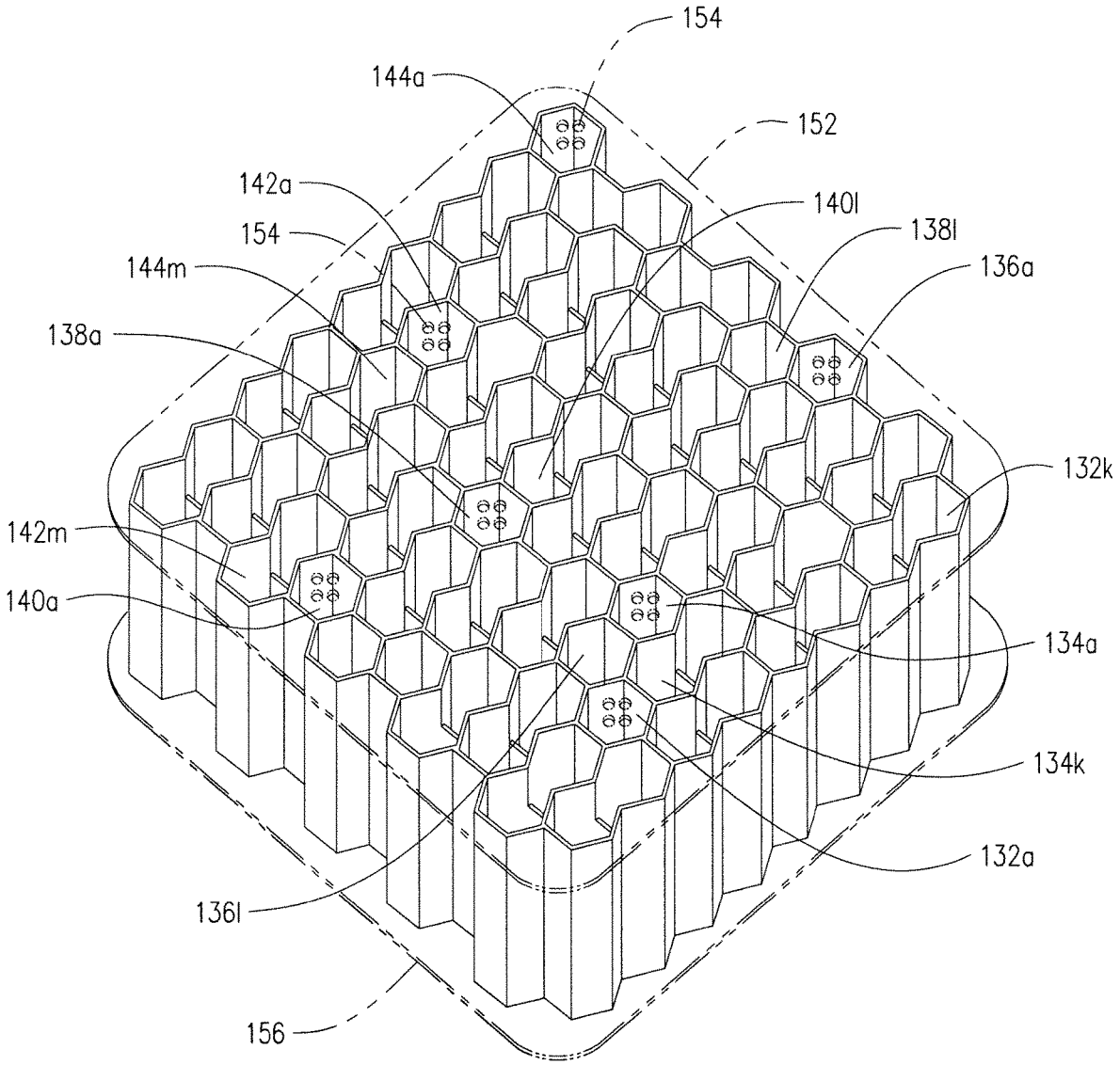

FIGS. 9 and 10 show an additional acoustic liner section 102. The dimensions of the section are identical to that described with respect to liner panel section 100 and as a result the same numbers for those dimensions will be used. The input in this case was 0 to 1,000 Hz. The resulting configuration included two (2) cell clusters 132 and 134 respectively with 11 acoustically connected cells, two (2) cell clusters 136 and 138 with 12 acoustically connected cells and three (3) cell clusters 142, 144, and 146 with 13 acoustically connected cells. Acoustic liner section 102 has face sheet 150 with perforations 154 and back plate 156. The first and last cells in a cell cluster are annotated with a subscript letter.

The frequency response of the particular cell cluster configuration for the embodiment of FIG. 9 is as follows, Clusters 132 and 134 attenuate sound having a frequency of 613 Hz to the desired level. Clusters 136 and 138 attenuate sound having a frequency of 562 Hz. Clusters 140, 142 and 144 attenuate sound having a frequency of 519 Hz. Thus the analysis described generated data indicating four peaks in the absorption spectrum was a desirable configuration. The analysis described can be conducted for a portion of an acoustic liner and used to arrive at a cell cluster configuration for an entire acoustic liner. If preferred, the overall volume of the acoustic liner may be considered and utilized in the analysis to arrive at a cell cluster configuration for the acoustic liner.

In the examples described with respect to FIGS. 6 and 9, the analysis was conducted based on the use of an existing available core, and considered only full depth cells in a cluster. The acoustic connectivity between core cells can be attained simply by machining portions of a cell wall as shown in the drawings.

Figure 14:
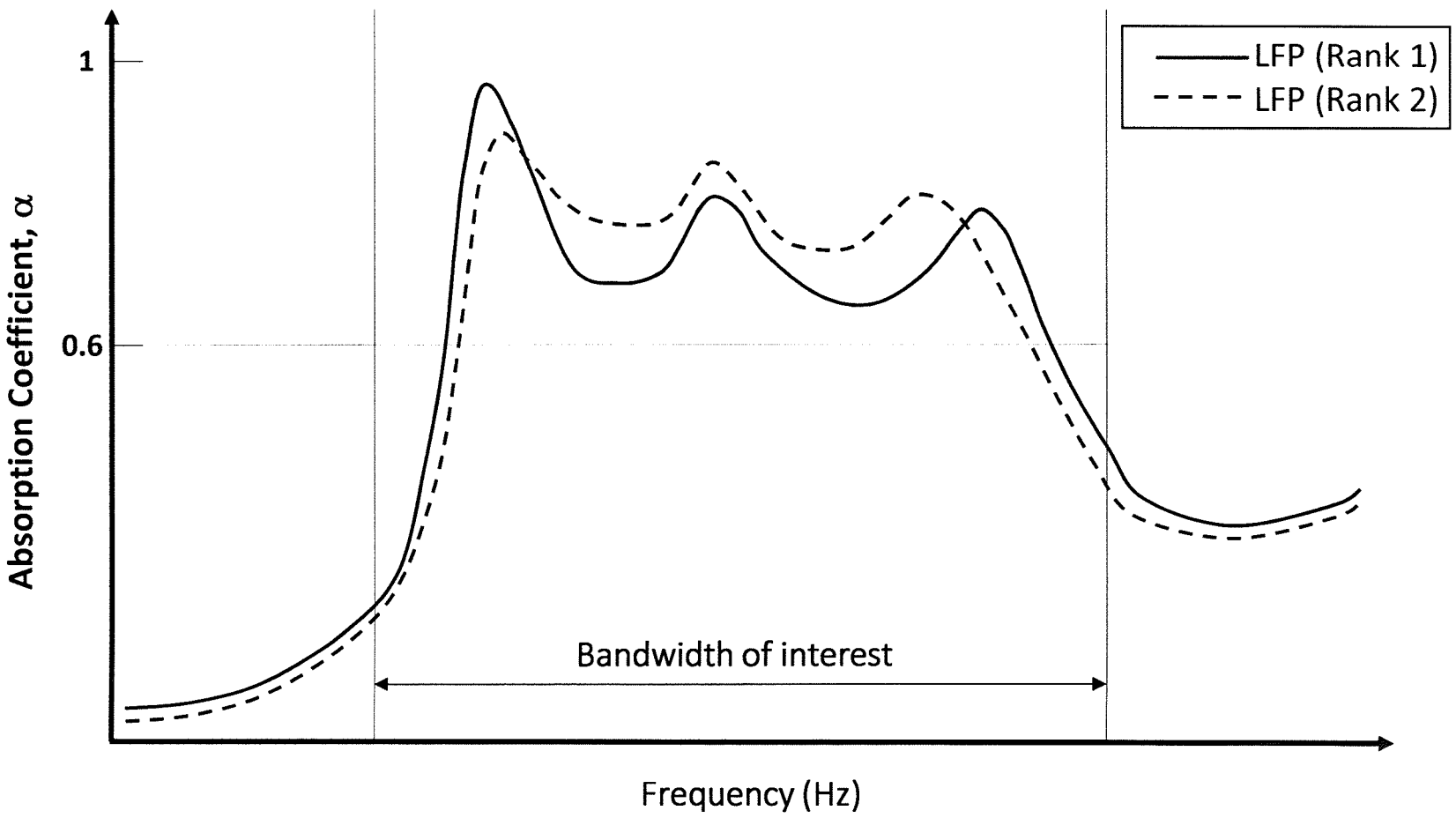
FIG. 14 is an exemplary graph showing potential responses of liner configurations.

In the foregoing examples, in any case there will be a number of different admissible liner configurations. Any of such liner configurations may be selected and utilized depending on the character of the sound spectrum to be addressed. However, to arrive at and select the optimal configuration it will be necessary to consider the aspect of the sound that is of concern, apply the LFP based method described herein and select configurations to fit the application. For example in some applications it may be desirable to select a configuration that is more concerned with addressing a peak frequency than a large band width. In the graphic in FIG. 14, while the overall LFP for the solid line may be higher, one could select the configuration that produced the dotted line, if the desire was to select the configuration that produced the best average absorption, since while LFP (rank 1) has a higher max peak M, greater threshold bandwidth $\beta$, and lower value of lower bound $\zeta$, LFP (rank 2) has better average absorption within the bandwidth of concern.

The method for designing disclosed herein can be conducted on a general use computer without being constrained to specific software, using for example MS Excel, VB, LabView, or Matlab for the GUI interface (or front end) to provide inputs, post-process and display results and using Matlab, Mathematica for ZKTL or FEA software such as Abaqus, COMSOL, or Ansys to run the analysis iterations. In essence, any general purpose programming language could be used to implement the entire design procedure making it highly portable.

The description herein has been primarily with respect to liner panels with a core having a plurality of individual cells. The path for the sound wave has been described as an acoustic path, and specifically a convoluted acoustic path. An acoustic path is not confined to a plurality of cells and may be defined in other shapes such as a length of tubing or other structural confinement. In other words, such tubing or other confinement may define an acoustic wave path, just as the connected cells in a cell cluster define an acoustic wave path for wave propagation. By way of example, a liner panel with hollow tubes having an acoustic path length sufficient to attenuate sound at a frequency range of interest may be designed using the process described herein. A plurality of such hollow tubes may be placed in a known volume, and the analysis may be conducted to determine the length of the hollow tubes based on the available space which will determine the number of hollow tubes that may be placed in the space.

Although the disclosed invention has been shown and described in detail with respect to a preferred embodiment, it will be understood by those skilled in the art that various changes in the form and detailed area may be made without departing from the spirit and scope of this invention as claimed. Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A non-transitory computer readable medium embodying programmed instructions which when executed by a computer processor are operable for performing a method comprising:

receiving a sound wave frequency range of interest;

receiving an available volume for an acoustic liner;

receiving information about a liner core to be placed in the available volume, the liner core defining a plurality of acoustic paths having different lengths; and identifying acoustic paths in the liner core with a length sufficient to attenuate a frequency within the range of interest; and disregarding any liner core configuration that includes an acoustic path having a length which will not attenuate a frequency within the range of interest, the remaining liner configurations comprising admissible liner configurations.

2. The computer readable medium of claim 1, further comprising:

calculating an acoustic property for each of the admissible liner configurations;

comparing the acoustic properties of the admissible liner configurations; and selecting the admissible liner configuration with the most desired acoustic property.

3. The computer readable medium of claim 2, the acoustic property comprising an LFP.

4. The computer readable medium of claim 2, the liner core comprising a plurality of individual core cells, wherein the acoustic paths comprise convoluted acoustic paths defined by a plurality of acoustically connected core cells.

5. The computer readable medium of claim 3, the LFP comprising $(\beta M/\zeta)\times 100$.

6. The computer readable medium of claim 3, further comprising receiving a minimum acceptable absorption coefficient for the admissible liner configurations and utilizing a prediction code to calculate the LFP for the admissible liner configurations.

7. The computer readable medium of claim 6, the prediction code comprising ZKTL.

8. A method of designing an acoustic liner configuration comprising:

selecting a liner volume;

identifying a frequency range of the sound to be attenuated by the acoustic liner;

providing a liner core to be placed in the available liner volume;

dividing the liner core into a plurality of individual core cells; and determining the lengths of acoustic paths of different core cell clusters that will attenuate a frequency within the identified frequency range, each core cell cluster comprising a plurality of acoustically connected cells and each acoustic liner configuration comprising a plurality of core cell clusters; and identifying a plurality of admissible acoustic liner configurations with core cell clusters having acoustic paths with a length sufficient to attenuate a sound wave within the identified frequency range to a predetermined acceptable level.

9. The method of claim 8, each of the admissible liner configurations comprising core cell clusters with acoustic paths having different lengths.

10. The method of claim 8, further comprising:

identifying an acoustic property of each of the different admissible liner configurations;

storing the acoustic property of each of the different admissible liner configurations;

comparing the acoustic property of each of the different admissible liner configurations; and selecting the admissible liner configuration with the most desired acoustic property.

11. The method of claim 10, wherein the acoustic property comprises an LFP.

12. The method of claim 11, further comprising identifying a desired absorption coefficient and using a prediction code to determine the acoustic property of the admissible liner configurations.

13. The method of claim 8 further comprising:

calculating an LFP representative of each admissible liner configuration;

comparing the LFPs for the admissible liner configurations; and selecting the admissible liner configuration with a desired LFP.

14. A method of designing an acoustic liner configured to attenuate sound in a predetermined frequency range, the method being implemented on a computer processor, the method comprising:

obtaining an available volume for the acoustic liner;

obtaining geometric information corresponding to the structure in the acoustic liner through which the sound will propagate;

utilizing an acoustic prediction code to identify admissible liner configurations, each of the admissible liner configurations having a plurality of acoustic paths with different lengths which will attenuate sound at a frequency within the predetermined frequency range.

15. The method of claim 14, the structure comprising a honeycomb core of core cells, the acoustic paths comprising convoluted acoustic paths defined by a plurality of acoustically connected core cells, the plurality of acoustically connected core cells comprising a core cell cluster.

16. The method of claim 15 comprising:

selecting an absorption threshold;

generating an acoustic property of each admissible liner configuration using at least the absorption threshold;

comparing the acoustic property of the admissible liner configurations; and selecting an admissible liner configuration with the most desirable acoustic property.

17. The method of claim 16, the acoustic property comprising an LFP.

18. The method of claim 16, the liner core being configured for use in an aircraft engine nacelle acoustic liner.

19. The method of claim 17, the LFP comprising $(\beta M/\zeta)\times 100$.

* * * * *